US008500211B2

(12) United States Patent
Lindblad

(10) Patent No.: US 8,500,211 B2
(45) Date of Patent: Aug. 6, 2013

(54) CLEANING CLOTH

(75) Inventor: Jan Lindblad, Danderyd (SE)

(73) Assignee: Qiangdi International Co., Limited, Zhejiang (CN)

( * ) Notice: Subject to any disclaimer, the term of this patent is extended or adjusted under 35 U.S.C. 154(b) by 581 days.

(21) Appl. No.: 12/667,081

(22) PCT Filed: Jun. 26, 2008

(86) PCT No.: PCT/SE2008/050783

§ 371 (c)(1),
(2), (4) Date: Dec. 29, 2009

(87) PCT Pub. No.: WO2009/005457

PCT Pub. Date: Jan. 8, 2009

(65) Prior Publication Data

US 2011/0010883 A1 Jan. 20, 2011

(30) Foreign Application Priority Data

Jun. 29, 2007 (SE) ..... 0701575

(51) Int. Cl.

| | |
|---|---|
| ***A47L 13/16*** | (2006.01) |
| ***D03D 27/00*** | (2006.01) |
| ***D06C 7/00*** | (2006.01) |

(52) U.S. Cl.

USPC ..... 300/21; 15/209.1; 15/228; 28/159; 28/165; 139/391

(58) Field of Classification Search

USPC ..... 15/208, 228, 229.1, 209.1; 28/159, 28/165; 139/391; 300/21

See application file for complete search history.

(56) References Cited

U.S. PATENT DOCUMENTS

| | | | | |
|---|---|---|---|---|
| 2,252,999 | A | 8/1941 | Wallach | |
| 4,679,859 | A * | 7/1987 | Wilson | 300/21 |
| 6,087,279 | A * | 7/2000 | Laun | 442/402 |
| 6,728,998 | B2 * | 5/2004 | Wang et al. | 24/451 |

FOREIGN PATENT DOCUMENTS

| | | | |
|---|---|---|---|
| CN | 1678785 | A | 10/2005 |
| CN | 1871391 | A | 11/2006 |
| EP | 0959164 | | 11/1999 |
| EP | 1211342 | A1 | 6/2002 |
| EP | 1496144 | | 1/2005 |
| WO | 2004/022832 | A1 | 3/2004 |
| WO | 2005/007959 | A1 | 1/2005 |

OTHER PUBLICATIONS

European Search Report, Dated Oct. 19, 2010, in Application No. EP08767249.

International Search Report mailed Oct. 14, 2008, in PCT application.

* cited by examiner

*Primary Examiner* — Randall Chin

(74) *Attorney, Agent, or Firm* — Young & Thompson

(57) ABSTRACT

Cleaning cloth includes a cleaning surface and an attachment surface of loop type arranged to allow attachment of the cleaning cloth to a cleaning instrument. The cleaning cloth includes a single textile layer having an activated arming yarn stiffening the cloth. There is also provided a method of producing such a cleaning cloth.

20 Claims, 5 Drawing Sheets

CLEANING CLOTH

TECHNICAL FIELD

The present invention relates to a cleaning cloth and in more detail to a cleaning cloth for a cleaning instrument or the like.

BACKGROUND OF THE INVENTION

Present reusable cleaning cloths for cleaning instruments or the like are generally comprised of two or more layers with different functionalities that are attached to each other. One example of a cleaning cloth 10 comprised of several layers is disclosed in FIG. 1, wherein the cleaning action is provided by a cleaning fabric 20, structural support (and possibly also moisture preservation) is provided by a support fabric 30 and attachment to the cleaning instrument is provided by a fastening fabric 40. The different functional layers are e.g. attached to each other by sewing or by an adhesive. Moreover, such cleaning cloths are often provided with a fray prevention edge in the form of a band or the like. Hence is production of such layered cleaning cloths includes a number of production stages, whereby they are expensive to produce.

One alternative to reusable cleaning cloths are disposable cleaning cloths comprised of non woven fabrics. However, such disposable cloths cannot be provided with a surface texture that gives an adequate cleaning result compared to textile cleaning cloths. Moreover, disposable cloths are disadvantageous from an environmental perspective.

There are many types of cleaning instruments available and one schematic example of such a cleaning instrument 60 in the form of a floor mop is illustrated in FIG. 2. The cleaning instrument 60 has a holding member 70 comprising a handle 80 and a cloth holding plate 90. The cloth holding plate 90 is fixed to or rotatably connected to the handle 80, and on the other face of the cloth holding plate 90 there is provided a cloth attachment structure 100 for holding a cleaning cloth 10. The cleaning cloth 10 is provided with a mating attachment structure 110 on one surface thereof. The attachment structure may for example be of Velcro® type, wherein one of the two connecting face members is a loop face member having many loops extending from the face so that many loops are situated outside, and the other of the above connecting face members is a hook face member having many hooks extending from the one face so that the above many hooks are situated outside.

SUMMARY OF THE INVENTION

The object of the invention is to provide a new cleaning cloth and method for producing such which overcomes the drawbacks of the prior art. This is achieved by the cleaning cloth as defined in the claims.

One advantage of the present invention is that it provides sufficient stiffness while being comprised of one single textile layer. Therefore it may be produced in a very economical manner.

Another advantage is that the cleaning cloth can be cut into desired size without further fray prevention steps.

Other embodiments of the invention are defined in the claims.

BRIEF DESCRIPTION OF THE DRAWINGS

To allow a better understanding, embodiments of the present invention will now be described, by way of non-limitative examples only, with reference to the accompanying drawings, in which:

FIG. 6*b* shows a detail of a section of the cleaning cloth in FIG. 6*a*.

DETAILED DESCRIPTION THE INVENTION

One problem is to manufacture a cleaning cloth comprising a functional cleaning surface, an attachment surface while still being sufficiently stiff and rigid to enable efficient handling during the cleaning procedure, in an industrially effective way. One way to achieve this is to make a unitary cleaning cloth wherein the cleaning surface, the attachment surface as well as the stiffness and rigidness are woven or knitted in one single step of production. Such a cleaning cloth will be comprised of one single textile layer, which due to its attributes can be minimized in size. Hence the material consumption is also reduced.

Figure 1:
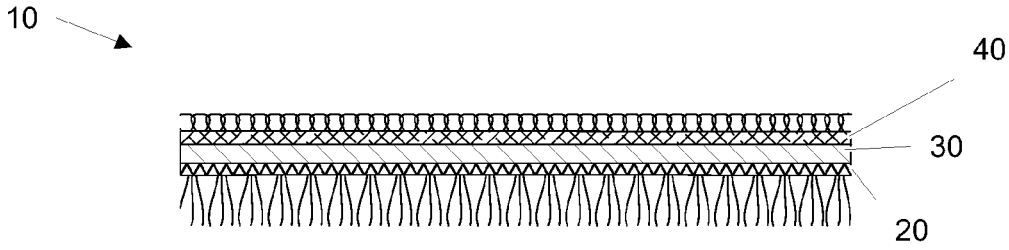
FIG. 1 is a schematic cross sectional view of a prior art layered cleaning cloth.
Figure 2:
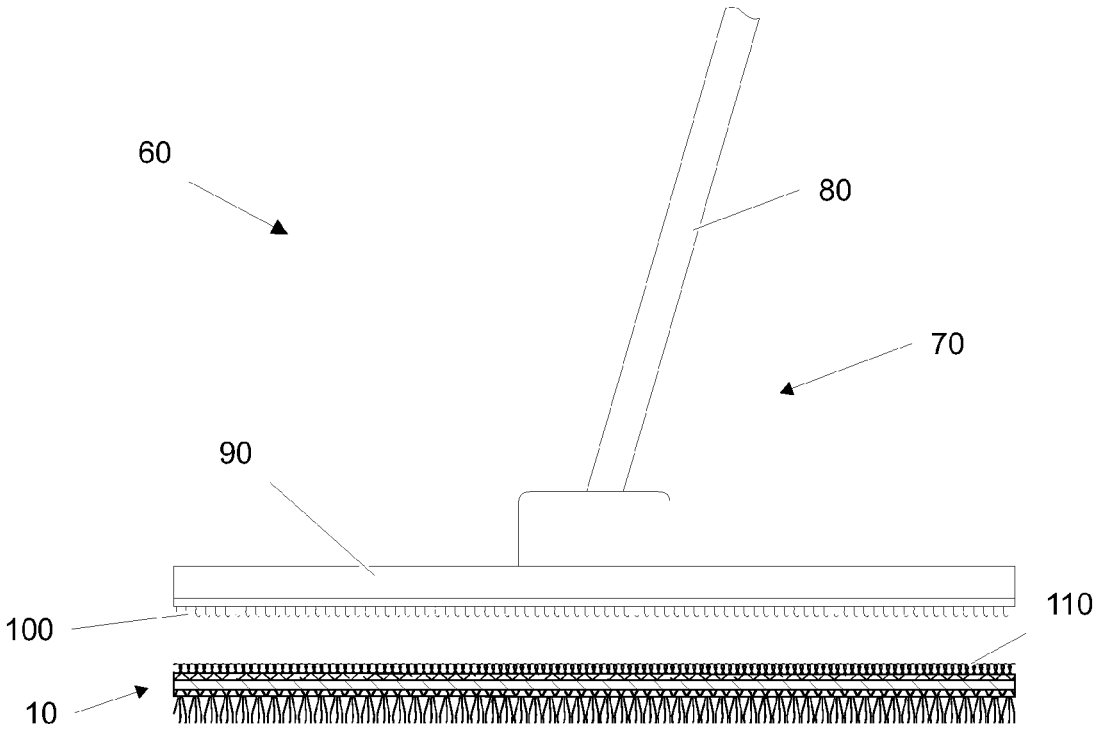
FIG. 2 is a schematic example of a cleaning instrument in the form of a floor mop.
Figure 3A:
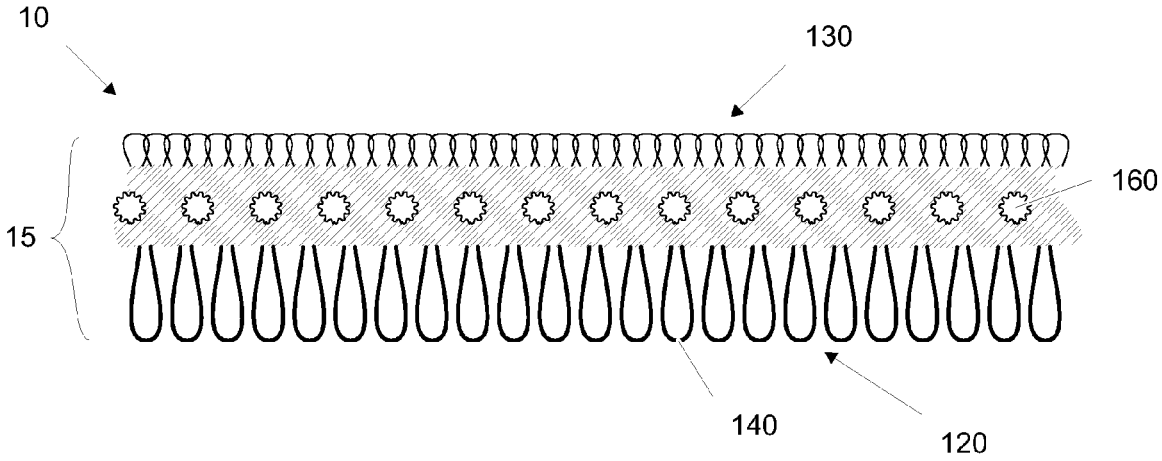
FIG. 3*a* shows a schematic, cross sectional view of a preferred embodiment of the present invention.
Figure 3B:
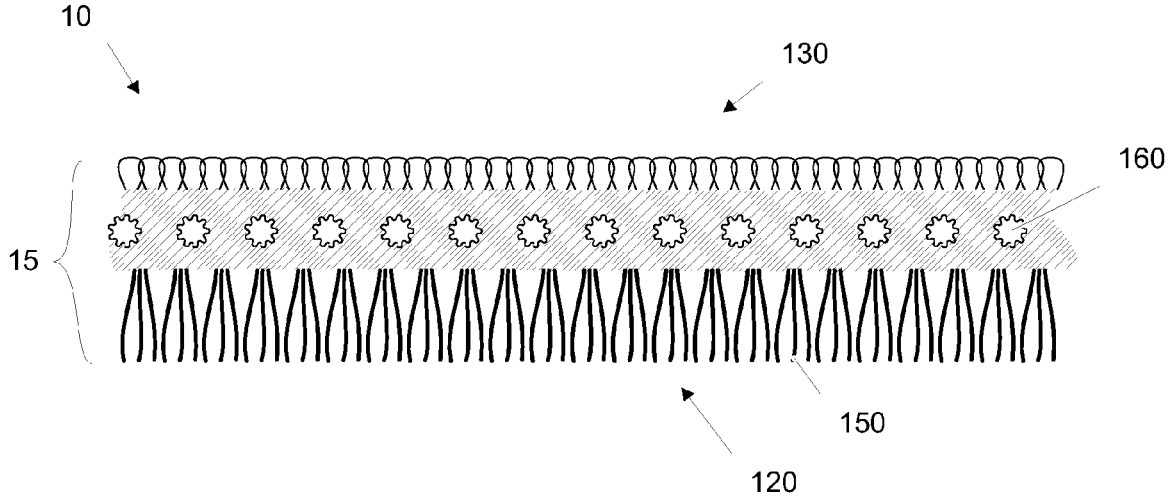
FIG. 3*b* shows a schematic, cross sectional view of a preferred embodiment of the present invention.

Referring to FIGS. 3*a* and 3*b*, the cleaning cloth 10 comprises in a single textile layer 15 a textile cleaning surface 120 and an attachment surface 130 of loop type arranged to allow attachment of the cleaning cloth to a cleaning instrument. The cleaning surface 120 may e.g. be comprised of looped threads 140 as is disclosed in FIG. 3*a*, cut loop threads 150 as is disclosed in FIG. 3*b* or any combination thereof.

In order to achieve stiffness and rigidity to facilitate handling of the cleaning cloth 10 during the cleaning procedure, an activated arming yarn 160 is provided in the cloth. The arming yarn may be any type of yarn that after the step of forming the single textile layer is possible to activate to provide stiffness to the single textile layer. According to one embodiment, the arming yarn at least partially is comprised of a material that can be activated to achieve adhesion to adjacent yarn threads in the single textile layer. The arming yarn may further stiffen in itself by the activation, whereby the single textile layer is further stiffened. The arming yarn may comprise melt-adhesion fibres that undergoes a "melt-adhesion" process upon activation by e.g. heat, electromagnetic radiation, an activator substance or the like, and which after the melt-adhesion process provides firm adhesion to adjacent threads, etc. One example of a melt-adhesion fiber having is a thermoplastic synthetic fiber (such as a fiber of modified polyester, polypropylene or polyethylene) having a melting point of from 80 to 150 DEG C. The heat melt-adhesion fiber may be composed of a melting polymer alone, or it may be a core-sheath type conjugate fiber in which the sheath component is composed of a heat melt-adhesion polymer having a low melting point compared to the core. According to one embodiment, the arming yarn is comprised of a yarn impregnated with an adhesive that can be activated, e.g. by heat, electromagnetic radiation, an activator substance or the like. According to one embodiment, the arming yarn is at least partially comprised of a cureable material that undergoes a curing process upon activation.

Figure 4A:
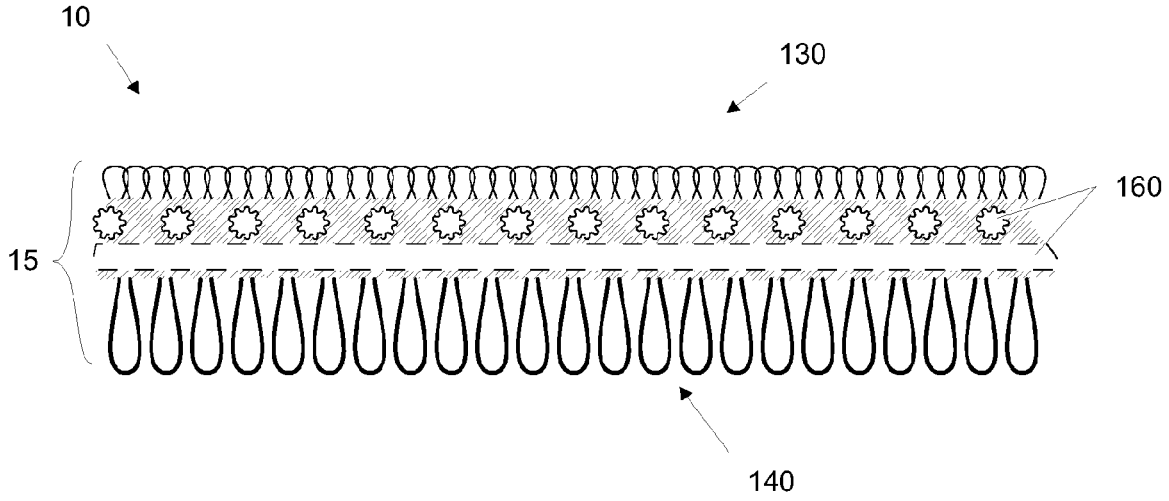
FIG. 4*a* shows a schematic, cross sectional view of a cleaning cloth according to an embodiment of the present invention with two crosswise arranged layers of arming yarn.
Figure 4B:
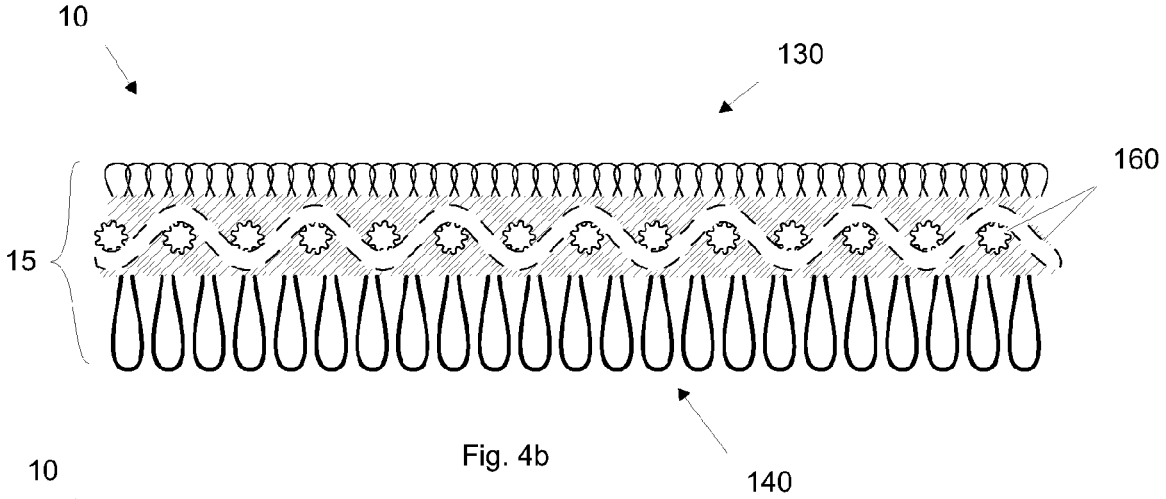
FIG. 4*b* shows a schematic cross sectional view of a cleaning cloth according to an embodiment of the present invention wherein the arming yarn threads are woven in a is network pattern.
Figure 4C:
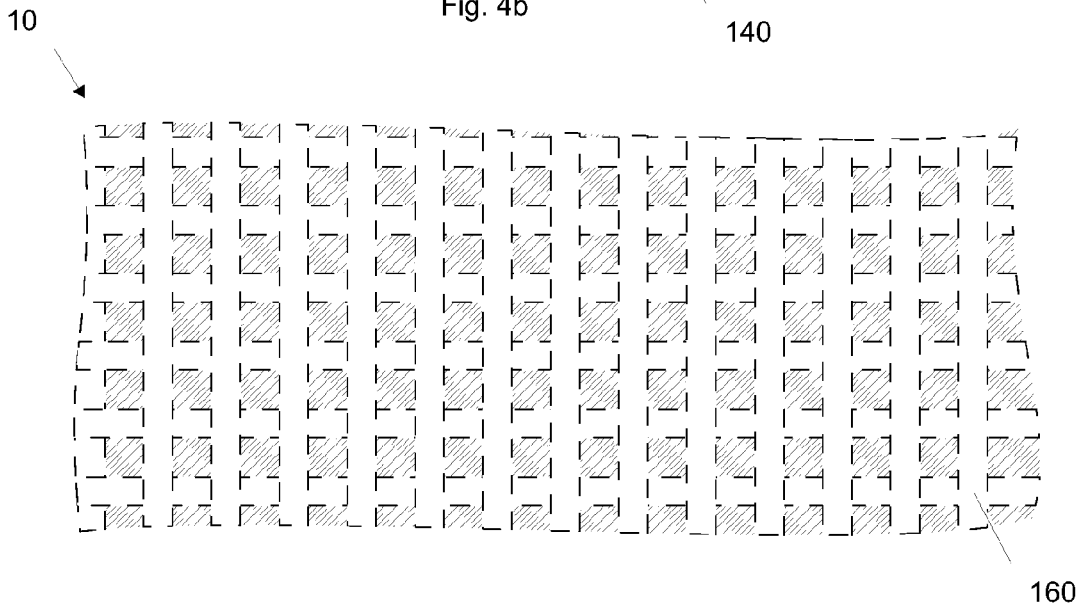
FIG. 4*c* shows a schematic view of the cleaning cloths according to FIG. 4*a* or 4*b* in the plane of the textile.

In the embodiments schematically shown in FIGS. 3*a* and 3*b*, the arming yarn 160 is disclosed as single yarn threads that are adhered to adjacent non arming threads 160 (not specifically disclosed) by activation. In FIGS. 4*a* to 4*c* the cleaning cloth comprises a network of arming yarn threads 160 that are adhered to each other and to adjacent non arming threads by activation. FIG. 4*a* schematically shows a cross sectional view of a cleaning cloth with two crosswise arranged layers of arming yarn, whereas in FIG. 4*b* the arming yarn threads are woven in a network pattern. FIG. 4*c* schematically show a cross sectional view of the cleaning cloths according to FIG. 4*a* or 4*b* in the plane of the textile. As is disclosed, in the figures, the arming yarn 160 may be arranged at an intermediated position between the attachment surface 130 and the cleaning surface 140.

The cleaning cloth according to the present invention may be formed using any available technique capable of producing a single textile layer, such as knitting, weaving or the like. Due to the many possible yarn structures available, the single textile layer is only schematically disclosed with respect to the internal structure of the textile.

In one embodiment, the cleaning cloth is formed from two yarns; an arming yarn 160 and a yarn that is used to form both the cleaning surface 120 and the attachment surface 130. In one embodiment, the cleaning surface 120 and the attachment surface 130 are formed by two different yarns, whereby the cleaning cloth is formed from three separate yarns. However, it is also possible that four or more separate yarns are used to form the cleaning cloth. The yarns used to form the different layers may be of any suitable type and made of any suitable fibres. Examples of fibres that can be used include natural vegetable fibers such as cotton and hemp, natural animal fibers such as silk and wool, regenerated fibers such as rayon, semi-synthetic fibers such as cellulose acetate, synthetic fibers such as polyester fibers represented by poly(ethylene terephthalate) fibers and poly(trimethylene terephthalate) fibers, polyamide fibers, poly(vinylidene chloride) fibers and polypropylene fibers.

Figure 5:
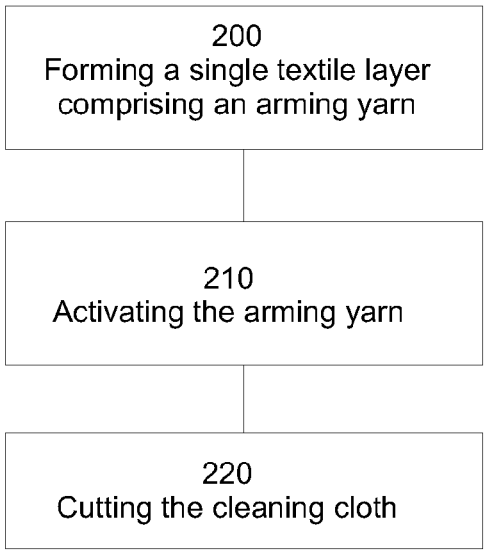
FIG. 5 is the process flow of a method of manufacturing the cleaning cloths of the present invention.

There is further provided a method of producing a cleaning cloth 10, shown in FIG. 5, comprising the steps:

forming 200 a single textile layer 15 comprising a cleaning surface 120, an attachment surface 130 of loop type and an arming yarn 160 that can be activated, and activating 210 the arming yarn 160.

The method may further comprise the step of cutting 220 the cleaning cloth into predetermined size and shape. As mentioned above, the step of forming the single textile layer may e.g. be performed by knitting, weaving or any other suitable process whereby the desired surfaces 120 and 130 may be provided. Further, as mentioned above, the step of activating the arming yarn may involve heat, electromagnetic radiation, an activator substance or the like.

Figure 6A:
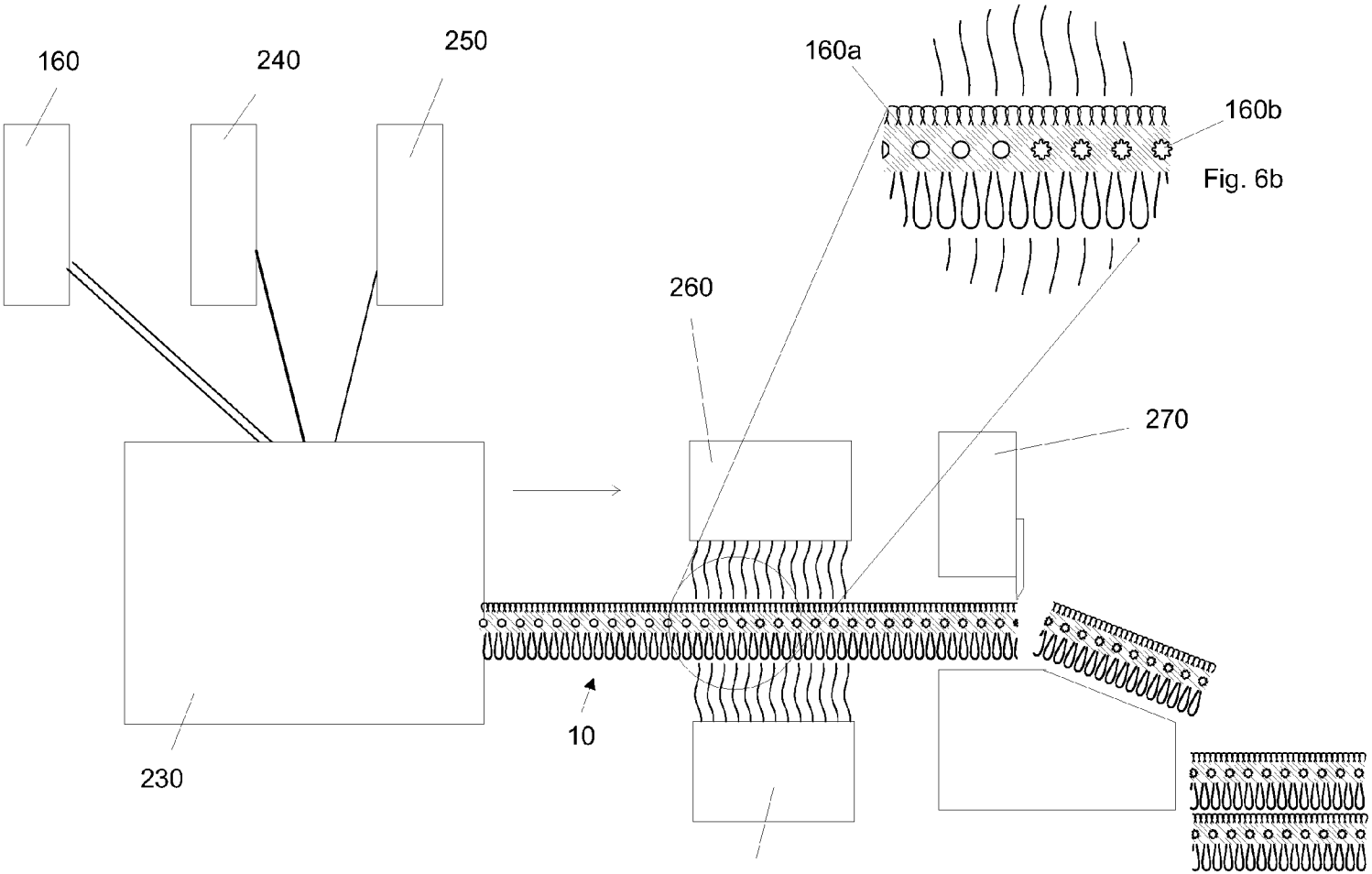
FIG. 6*a* schematically shows a system for producing a cleaning cloth according to the method of FIG. 5.

FIG. 6*a* schematically shows a system for producing a cleaning cloth 10 according to the method of FIG. 5. In said system, the step of forming 200 the cleaning cloth 10 is performed by a cloth forming apparatus 230. In the disclosed embodiment, three types of yarn is supplied to the cloth forming apparatus 230; cleaning yarn 240 for forming the cleaning surface 120, attachment yarn 250 for forming the attachment surface 130 and arming yarn 160. The cloth forming apparatus 230 may be any suitable knitting or weaving machine or the like. The so produced non activated cleaning cloth 10 is thereafter fed to an is activator 260 wherein the step of activating 210 the arming yarn 160 is performed. FIG. 6*b* shows a schematic enlarged view of the activation process, wherein the non activated arming yarn is shown as circular threads 160*a*, whereas the activated arming yarn 160*b* is shown with deformed surface layers, indicating a partial melting or the like as is discussed in detail above. Finally, the activated cleaning cloth 10 is fed to a cutting station 270 for cutting the cloth.

The invention claimed is:

1. Cleaning cloth comprising a single layer of fabric having a cleaning surface and an attachment surface of loop type arranged to allow attachment of the cleaning cloth to a cleaning instrument, the single layer of fabric further comprising an activated arming yarn stiffening the cloth.

2. Cleaning cloth according to claim 1, characterized in that the arming yarn at least partially is comprised of a material that can be activated.

3. Cleaning cloth according to claim 2, characterized in that the arming yarn is a melt-adhesion yarn.

4. Cleaning cloth according to claim 1, characterized in that the arming yarn is comprised of a yarn impregnated with an adhesive that can be activated.

5. Cleaning cloth according to claim 1, characterized in that the arming yarn is activated by heat.

6. Cleaning cloth according to claim 1, characterized in that the arming yarn is activated by electromagnetic radiation.

7. Cleaning cloth according to claim 1, characterized in that the arming yarn is activated by an activator substance.

8. Cleaning cloth according to claim 1, characterized in that the single layer of fabric comprises single arming yarn threads that are adhered to adjacent non arming threads by activation.

9. Cleaning cloth according to claim 1, characterized in that the single layer of fabric comprises a network of arming yarn threads that are adhered to each other and adjacent non arming threads by activation.

10. Cleaning cloth according to claim 1, characterized in that the arming yarn is arranged at an intermediated position between the attachment surface and the cleaning surface.

11. Cleaning cloth according to claim 1, characterized in that the single layer of fabric is knitted.

12. Cleaning cloth according to claim 1, characterized in that the single layer of fabric is woven.

13. Method of producing a cleaning cloth comprising the steps:

forming a single layer of fabric comprising a cleaning surface, an attachment surface of loop type and an arming yarn that can be activated, and activating the arming yarn.

14. Method according to claim 13 comprising the step of cutting the cleaning cloth into predetermined size and shape.

15. Method according to claim 14 wherein the step of forming the single layer of fabric is performed by knitting.

16. Method according to claim 13 wherein the step of forming the single layer of fabric is performed by knitting.

17. Method according to claim 13 wherein the step of forming the single layer of fabric is performed by weaving.

18. Method according to claim 13 wherein the step of activating the arming yarn involves heating the cleaning cloth.

19. Method according to claim 13 wherein the step of activating the arming yarn involves irradiating the cleaning cloth with electromagnetic radiation.

20. Method according to claim 13 wherein the step of activating the arming yarn involves supplying an activator substance.

* * * * *

UNITED STATES PATENT AND TRADEMARK OFFICE

CERTIFICATE OF CORRECTION

PATENT NO. : 8,500,211 B2
APPLICATION NO. : 12/667081
DATED : August 6, 2013
INVENTOR(S) : Jan Lindblad It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 650 days.

Signed and Sealed this
Fifteenth Day of September, 2015

Michelle K. Lee

Michelle K. Lee
*Director of the United States Patent and Trademark Office*